United States Patent [19]

Yamagishi et al.

[11] Patent Number: 5,009,428

[45] Date of Patent: Apr. 23, 1991

[54] GOLF BALL

[75] Inventors: Hisashi Yamagishi; Shinichi Kakiuchi, both of Yokohama; Seisuke Tomita, Tokorozawa, all of Japan

[73] Assignee: Bridgestone Corporation, Tokyo, Japan

[21] Appl. No.: 517,730

[22] Filed: May 2, 1990

Related U.S. Application Data

[63] Continuation-in-part of Ser. No. 435,207, Nov. 4, 1989.

[30] Foreign Application Priority Data

Dec. 2, 1988 [JP] Japan ..... 63-305561

[51] Int. Cl.[5] ..... A63B 37/12

[52] U.S. Cl. ..... 273/232; 40/327

[58] Field of Search ..... 273/232; 40/327

[56] References Cited

U.S. PATENT DOCUMENTS 4,844,472 7/1989 Ihara ..... 273/232

*Primary Examiner*—George J. Marlo

[57] ABSTRACT

A golf ball having at least three types of dimples arranged in a specific distribution pattern has improved aerodynamic symmetry and offers consistent flying performance. Three phantom orthogonal great circles are drawn on the spherical surface of the ball to define eight spherical regular triangles, and phantom perpendiculars are extended from the three apexes of each spherical regular triangle to the opposite sides to divide the spherical regular triangle into six equal spherical right triangles, thereby dividing the entire spherical ball surfaces into 48 equal spherical right triangles.

dimples are arranged on every two adjoining spherical right triangles such that the dimples are in axial symmetry with respect to the common side of the two adjoining spherical right triangles and the dimples do not intersect the great circles.

4 Claims, 4 Drawing Sheets

①>②>③

①>②>③>④

GOLF BALL

CROSS REFERENCE TO RELATED APPLICATION

This is a continuation-in-part application of copending application Ser. No. 07/435,207 filed Nov. 9, 1989.

This invention relates to golf balls having dimples properly distributed for aerodynamic symmetry and thus exhibiting consistent flying performance.

BACKGROUND OF THE INVENTION

Golf balls are required to meet aerodynamic symmetry as prescribed in Professional Golfers' Association Rule, for example, Japan Professional Golfers' Association Rule, Appendix III, Ball (C). It is required that when hit under given conditions, a ball give essentially no difference in trajectory and distance irrespective of different hitting positions.

Currently commercially available golf balls are considered to meet the required aerodynamic symmetry as long as the prescription is concerned, but tend to give a slight difference in trajectory and distance depending on a particular hitting position. If balls are aerodynamically asymmetric, then such asymmetry, though quite slight, would cause inconsistent shots especially for skilled players and professional golfers.

One of the causes for aerodynamically asymmetric golf balls is the presence of a seam line. Since golf balls are most often manufactured by compression molding in mated mold halves each having a semispherical molding surface, a seam line is formed at the mating line between the mold halves as a great circle with which none of the dimples intersect. Therefore, seam lines are inevitably present on golf balls for the manufacture reason.

The ball hitting test prescribed in Japan, UK or US Professional Golfers' Association Rule, Appendix III, Ball (C) is now described in detail. Referring to FIGS. 8 and 9, a golf ball a is shown as having a center d and a seam line b. Two hitting tests are prescribed, that is, a hitting test of FIG. 8 called pole hit where the golf ball a is hit at f so as to produce a back spin about a diametrical line e connecting three points, two diametrically opposite points c and c on the seam line b and the center d, and a hitting test of FIG. 9 called seam hit where the golf ball a is hit at i so as to produce a back spin about a diametrical line h extending perpendicular to a circular plane g having a circumference coincident with the seam line b and passing through the center d. The aerodynamic symmetry of the ball is evaluated in terms of differences in carry distance, peak angle (the angle of a straight line connecting the maximum point the ball reaches and the ground location where the ball is hit with respect to the horizontal line), and flight time between the two hitting tests. It is known for golf balls having a seam line that in these hitting tests, the balls given a pole hit assume a trajectory having a larger peak angle than in the case of a seam hit, resulting in a difference in carry distance and flight time.

It was proposed to improve the aerodynamic symmetry of a ball by providing on the ball surface a plurality of great circles which do not intersect the dimples as the seam line does not. One example is an icosahedral distribution which is achieved by equally dividing the ball surface into 20 triangles of a regular 20-sided (icosahedral) body and distributing dimples in each of the triangles. There were proposed several similar golf balls having a high degree of geometrical uniformity. Room for improvement is left in such geometrically uniform golf balls.

SUMMARY OF THE INVENTION

Therefore, an object of the present invention is to provide a golf ball having improved aerodynamic symmetry and thus exhibiting consistent flying performance.

Briefly stated, the present invention pertains to a golf ball having at least three types of dimples on the surface thereof. The present invention assumes that the ball has a phantom spherical surface, three phantom orthogonal great circles are drawn on the spherical surface to define eight spherical regular triangles, and phantom perpendiculars are extended from the three apexes of each said spherical regular triangle to the opposite sides to divide the spherical regular triangle into six equal spherical right triangles, thereby dividing the entire spherical right surface into 48 equal spherical right triangles. Dimples are arranged on every two adjoining spherical right triangles in axial symmetry with respect to the common side of the triangles such that the dimples may not intersect the great circles.

BRIEF DESCRIPTION OF THE DRAWINGS

The above and other objects, features, and advantages of the present invention will be better understood from the following description taken in conjunction with the accompanying drawings, in which.

DESCRIPTION OF THE PREFERRED EMBODIMENTS

Figure 1:
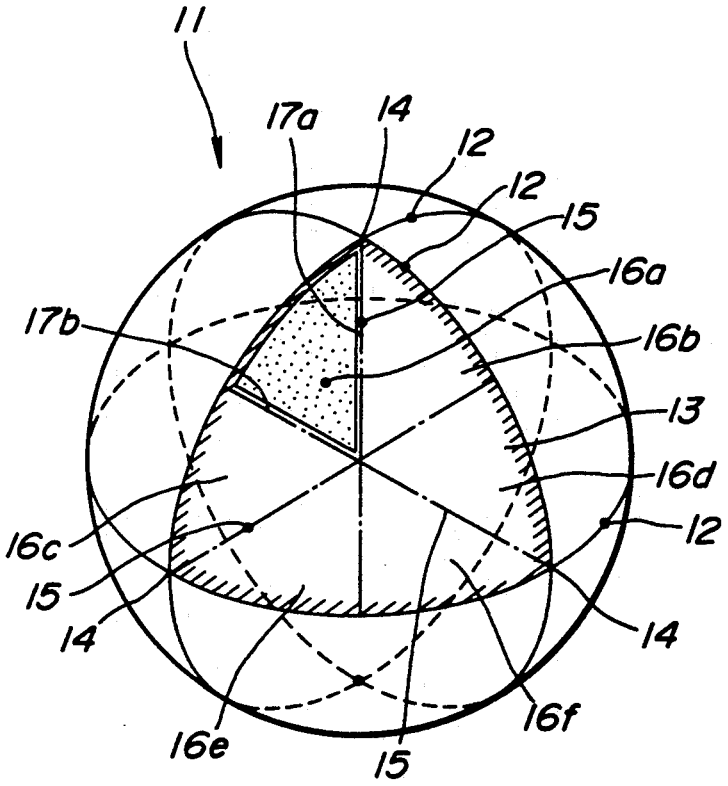
FIG. 1 is a geometrical illustration of a golf ball, showing the dimple distribution of the invention.

Referring to FIG. 1, there is illustrated the geometry of a golf ball designated at 11. The ball 10 has a phantom spherical surface. Three phantom orthogonal great circles 12, 12, 12 are drawn on the spherical surface to define eight spherical regular triangles 13, 13, . . . so that the spherical ball surface is equally divided into eight sections. Phantom perpendiculars 15, 15, 15 are extended from the three apexes 14, 14, 14 of each said spherical regular triangle 13 to the opposite sides to divide the spherical regular triangle 13 into six equal spherical right triangles **16*a*, 16*b*, 16*c*, 16*d*, 16*e*, 16*f*, thereby dividing the entire spherical ball surface into 48 equal spherical right triangles. Dimples of three or more types (not shown in FIG. 1) are arranged on each of these spherical right triangles. More particularly, dimples are arranged on every two adjoining spherical right triangles (for example, 16*a* and 16*b*, 16*a* and 16*c* and so on) in axial symmetry with respect to the common side between the triangles (for example, common side 17*a* between 16*a* and 16*b*, common side 17*b* between 16*a* and 16*c*, and so on). The dimples do not intersect the great circles 12, 12, 12. It should be understood that one of the great circles 12, 12, 12 can coincide with a seam line produced in the manufacture of a golf ball. The dimples can intersect the sides of the spherical right triangles 16 except those sides coincident with the great circles 12, 12, 12.**

Figure 2:
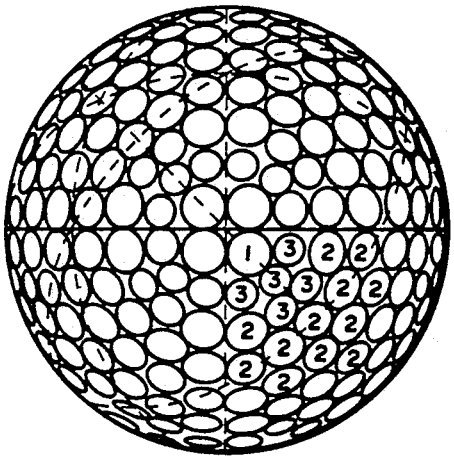
FIGS. 2 and 3 are plan views showing different distribution patterns of dimples on golf balls.
Figure 3:
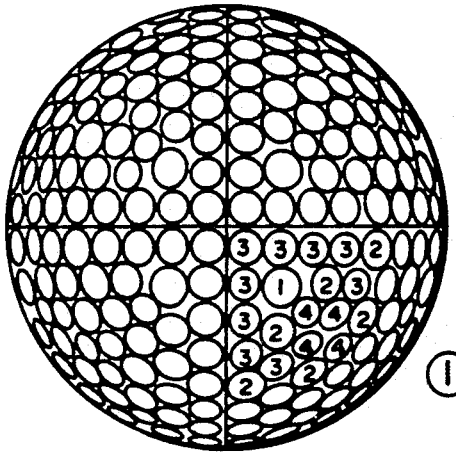

Illustrative distributions of dimples meeting the above-defined requirement are shown in FIGS. 2 and 3. In FIG. 2, three types of dimples 1, 2, and 3 are arranged on every two adjoining spherical right triangles such that the dimples are in axial symmetry with respect to the common side between the triangles and the dimples do not intersect the great circles. In FIG. 3, four types of dimples 1, 2, 3, and 4 are similarly arranged. It is to be noted in FIGS. 2 and 3 that the area of dimples decreases in the order of their reference numeral, that is, dimples 1 have a larger area than dimples 2, dimples 2 have a larger area than dimples 3, and so on.

The dimples arranged in the spherical surface of a ball include three or more groups of dimples each preferably having a diameter in the range of from 2.7 to 4.4 mm, a depth in the range of from 0.15 to 0.24 mm, and a ratio of diameter to depth in the range between 10 and 35, more preferably between 13 and 25, though the invention is not limited thereto.

The dimples distributed on the golf ball of the invention are of at least three types as described above. Preferably, three, four or five types of dimples are arranged on the ball. The dimple type is distinguished in diameter and/or depth. In general, 360 to 560 dimples in total are distributed on the ball, and the percent area occupied by the dimples is preferably at least 70%, especially 70 to 90% of the entire ball surface (phantom spherical surface), ensuring further improved aerodynamic symmetry.

Preferred dimple arrangements are regular icosahedral, regular dodecahedral, and regular octahedral arrangements. The dimples may preferably be distributed uniformly on the ball surface according to any of the above-mentioned arrangements.

The golf balls of the invention may be embodied as solid golf balls including one- and two-piece golf balls and thread-wound golf balls. Their manufacture may be carried out by any desired conventional method.

The dimple design defined by the present invention may be applied to any type of golf ball including small balls having a diameter of at least 41.15 mm and a weight of up to 45.92 g, and large balls having a diameter of at least 42.67 mm and a weight of up to 45.92 g.

There has been described a golf ball having dimples arranged in a specific distribution pattern. The ball provides improved aerodynamic symmetry and a minimized difference in trajectory and distance due to different hitting positions, that is, different axes of back spin, thus offering consistent flying performance.

EXAMPLE

Examples of the invention are given below by way of illustration and not by way of limitation.

Examples 1-3 and Comparative Example

There were prepared two-piece balls of the large size (diameter 42.67 mm) using the core and the cover of the following formulation. Each ball had dimples whose dimension, number, and distribution pattern are shown in Table 1. Except the dimples, the remaining components were the same for all the balls.

| Two-piece ball | |
|---|---|
| Composition | Parts by weight |
| Core | |
| Poly(cis-1,4-butadiene) rubber | 100 |
| Zinc dimethacrylate | 30 |
| Filler | appropriate |
| Peroxide | appropriate |
| Cover | |
| Ionomer resin (Surlyn ® 1707, E. I. duPont, Shore D hardness 68) | 100 |
| Titanium dioxide | 1 |
| Thickness: 2.3 mm | |

The dimple distribution patterns used are shown in FIGS. 4 through 7. In the figures, numeral 1 designates the largest dimples, 2 designates second largest dimples, and so forth.

The golf balls were evaluated for aerodynamic symmetry by the hitting test prescribed in PGA Rule, Appendix III, Ball (C). That is, aerodynamic symmetry was evaluated in terms of a difference in carry, total distance (carry plus run), and peak angle between the pole hit and the seam hit. The results are also shown in Table 1.

TABLE 1

Figure 4:
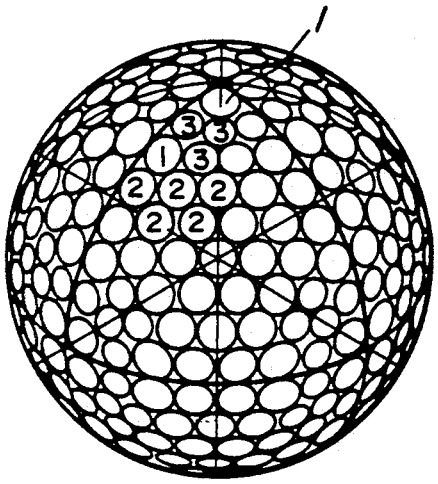
FIGS. 4 to 6 are plan views showing further embodiments of the invention.
Figure 5:
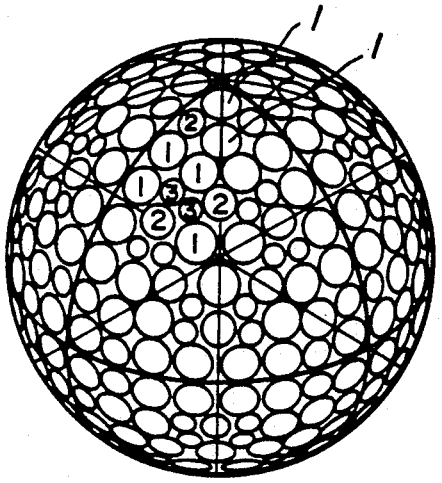
Figure 6:
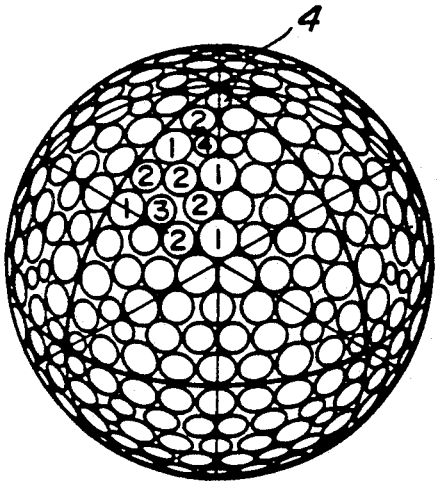
Figure 7:
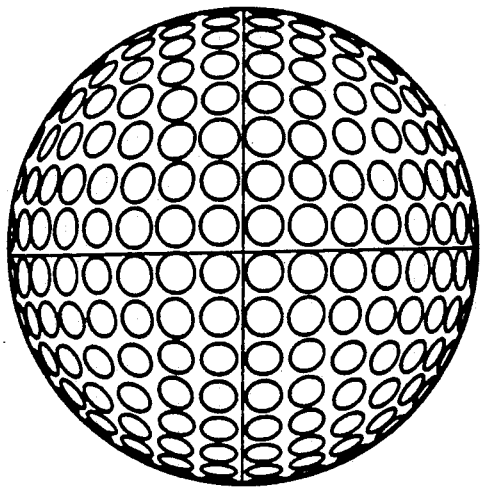
FIG. 7 is a plan view of the golf ball used in Comparative Example.
Figure 8:
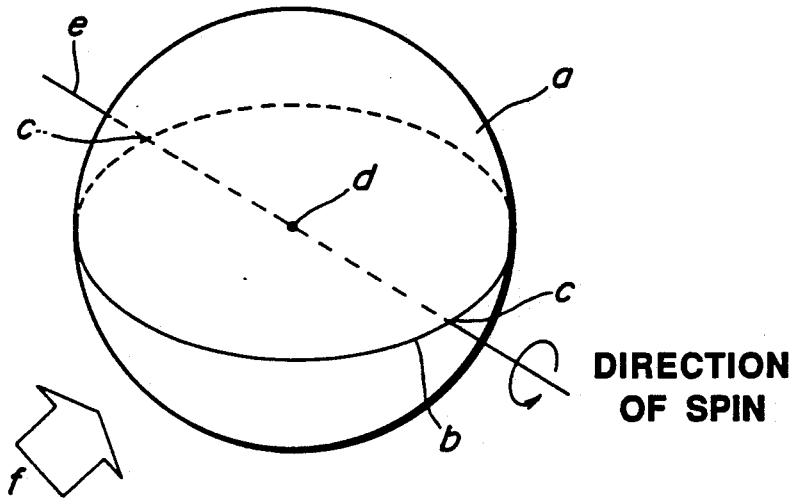
FIGS. 8 and 9 illustrate how to evaluate the aerodynamic symmetry of a golf ball.
Figure 9:
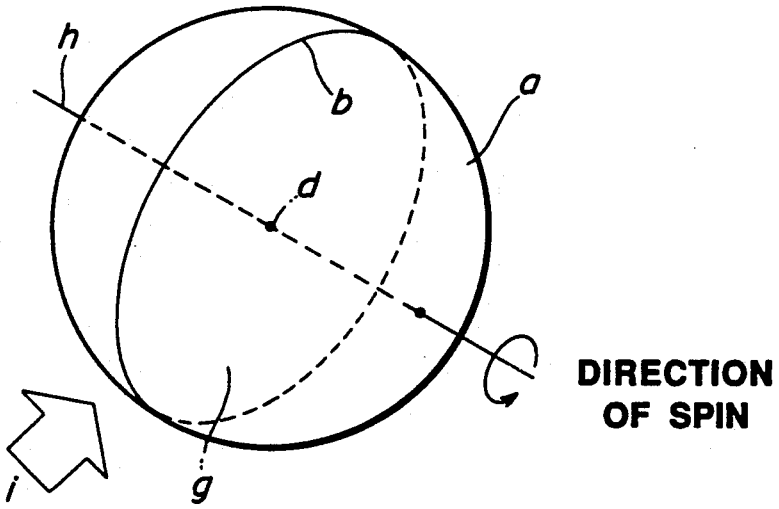

| | Example 1 | Example 2 | Example 3 | Comparative Example |
|---|---|---|---|---|
| Dimples (circular) | | | | |
| Dimple type (1) | 4.20 × 0.205 mm<br>72 | 4.10 × 0.195 mm<br>216 | 4.10 × 0.185 mm<br>144 | 3.75 × 0.220 mm<br>336 |
| type (2) | 3.90 × 0.200 mm<br>192 | 3.60 × 0.170 mm<br>96 | 3.55 × 0.160 mm<br>216 | — |
| type (3) | 3.20 × 0.155 mm<br>120 | 2.50 × 0.120 mm<br>96 | 3.20 × 0.145 mm<br>48 | — |
| type (4) | — | — | 2.45 × 0.110 mm<br>72 | — |
| Total dimple number | 384 | 408 | 480 | 336 |
| Distribution pattern | FIG. 4 | FIG. 5 | FIG. 6 | FIG. 7 |
| Surface occupied | 74.4% | 75.2% | 83.3% | 64.9% |
| Aerodynamic symmetry | | | | |
| Carry, m | 1.2 | 0.8 | 0.3 | 2.0 |
| Total distance, m | 1.5 | 1.1 | 0.7 | 4.0 |
| Peak angle, ° | 0.08 | 0.07 | 0.03 | 0.2 |

*Dimple type is expressed in diameter (mm), depth (mm), and number, with the diameter and depth shown at the upper line and the number at the lower line.

As seen from Table 1, the golf balls of the invention have improved aerodynamic symmetry and offer consistent flying performance.

Although some preferred embodiments have been described, many modifications and variations may be made thereto in the light of the above teachings. It is therefore to be understood that within the scope of the appended claims, the invention may be practiced otherwise than as specifically described.

We claim:

1. A golf ball having at least three types of dimples on the surface thereof, wherein provided that the ball has a phantom spherical surface, three phantom orthogonal great circles are drawn on the spherical surface to define eight spherical regular triangles, and phantom perpendiculars are extended from the three apexes of each said spherical regular triangle to the opposite sides to divide the spherical regular triangle into six equal spherical right triangles, thereby dividing the entire spherical ball surface into 48 equal spherical right triangles, dimples are arranged on every two adjoining spherical right triangles such that the dimples are in axial symmetry with respect to the common side of the two adjoining spherical right triangles and the dimples do not intersect the great circles.

2. The golf ball of claim 1 wherein one of the great circles coincides with a seam line resulting from the ball manufacture.

3. The golf ball of claim 1 wherein three, four or five types of dimples are present.

4. The golf ball of claim 1 wherein 360 to 560 dimples are present in total.

* * * * *